US007406725B2

(12) United States Patent
Martin et al.

(10) Patent No.: US 7,406,725 B2
(45) Date of Patent: Aug. 5, 2008

(54) BEDSIDE BASSINETTES

(75) Inventors: Bruce Martin, Malibu, CA (US); Sharon Forshpan, Malibu, CA (US)

(73) Assignee: Arm's Reach Concepts, Inc., Malibu, CA (US)

( * ) Notice: Subject to any disclaimer, the term of this patent is extended or adjusted under 35 U.S.C. 154(b) by 0 days.

(21) Appl. No.: 11/223,902

(22) Filed: Sep. 9, 2005

(65) Prior Publication Data

US 2007/0056097 A1 Mar. 15, 2007

Related U.S. Application Data

(63) Continuation-in-part of application No. 11/209,401, filed on Aug. 22, 2005, which is a continuation of application No. 10/448,538, filed on May 28, 2003, now Pat. No. 6,931,677.

(51) Int. Cl.
*A47D 7/00* (2006.01)

(52) U.S. Cl. ..... 5/93.2; 5/93.1; 5/95; 5/100; 5/655

(58) Field of Classification Search ..... 5/93.1, 5/93.2, 95, 100, 655, 424–430
See application file for complete search history.

(56) References Cited

U.S. PATENT DOCUMENTS

| | | | |
|---|---|---|---|
| 620,069 | A | 2/1899 | Cobb |
| 874,421 | A | 12/1907 | Nail |
| 1,138,451 | A | 5/1915 | Bugele |
| 1,267,244 | A | 5/1918 | McMillan |
| 1,283,169 | A | 10/1918 | Hasson |
| 2,553,087 | A | 5/1951 | Hanson |
| 2,565,988 | A | 8/1951 | Price |
| 2,566,790 | A | 9/1951 | Bloomfield |
| 2,548,769 | A | 10/1951 | Burgin |
| 2,590,315 | A | 3/1952 | Hawley, Jr. |
| 2,632,186 | A | 3/1953 | Berk |
| 2,691,176 | A | 10/1954 | Saldana |
| 2,822,950 | A | 2/1958 | Hill |
| 3,103,669 | A | 9/1963 | Mundis |
| 3,427,666 | A | 2/1969 | Saxe |
| 3,438,069 | A | 4/1969 | Long |
| 3,659,297 | A | 5/1972 | Schutz |
| 3,833,947 | A | 9/1974 | Sorensen |
| 3,896,513 | A | 7/1975 | Boucher |
| 4,070,716 | A | 1/1978 | Satt et al. |
| 4,558,801 | A | 12/1985 | Vilutis |
| 4,750,223 | A | 6/1988 | D'Arcy |

(Continued)

OTHER PUBLICATIONS

Century Fold 'N Go Instruction Manual Sep. 2000.

(Continued)

*Primary Examiner*—Frederick L. Lagman
(74) *Attorney, Agent, or Firm*—Gibbons, P.C.

(57) ABSTRACT

A bassinette having a front wall that may selectively be set at a height substantially equal to the height of other walls of the bassinette, or alternatively released to allow the front wall to have a lower height than remaining walls, wherein the method of attachment of a cross-member supporting the top edge comprises receiver cups, and a retractable tongue to allow the cross-member to be selectively trapped between the receiver cups, in a manner requiring only a single hand for insertion and removal of the cross-member from the structure of the bassinette.

17 Claims, 8 Drawing Sheets

U.S. PATENT DOCUMENTS

| | | | | |
|---|---|---|---|---|
| 4,811,437 | A | 3/1989 | Dillner et al. | |
| 4,967,432 | A | 11/1990 | Kujawski | |
| 4,993,551 | A | 2/1991 | Lindsay | |
| 5,148,561 | A | 9/1992 | Tharalson et al. | |
| 5,163,190 | A * | 11/1992 | Hwang | 5/93.2 |
| 5,172,435 | A | 12/1992 | Griffen et al. | |
| 5,174,447 | A | 12/1992 | Fleming | |
| 5,293,655 | A | 3/1994 | VanWinkle et al. | |
| 5,339,470 | A | 8/1994 | Shamie | |
| 5,349,709 | A | 9/1994 | Cheng | |
| 5,430,899 | A | 7/1995 | Chisholm | |
| 5,548,005 | A | 8/1996 | Kurth et al. | |
| 5,553,336 | A | 9/1996 | Mariol | |
| 5,581,827 | A | 12/1996 | Fong et al. | |
| 5,581,833 | A | 12/1996 | Zenoff | |
| 5,661,861 | A | 9/1997 | Matthews | |
| 5,711,040 | A | 1/1998 | Huang | |
| 5,802,634 | A | 9/1998 | Onishi et al. | |
| 5,813,064 | A | 9/1998 | Hartenstine | |
| 5,822,817 | A | 10/1998 | Carew et al. | |
| 5,845,349 | A | 12/1998 | Tharalson et al. | |
| 5,865,407 | A | 2/1999 | Effa | |
| 5,930,854 | A | 8/1999 | O'Neill et al. | |
| 5,941,408 | A | 8/1999 | Sherman | |
| 6,058,528 | A | 5/2000 | Yang | |
| 6,112,347 | A | 9/2000 | Tharalson et al. | |
| 6,148,456 | A | 11/2000 | Tharalson et al. | |
| 6,189,697 | B1 | 2/2001 | Davis | |
| 6,192,535 | B1 | 2/2001 | Warner | |
| 6,202,228 | B1 | 3/2001 | Cox | |
| 6,305,567 | B1 | 10/2001 | Sulpizio | |
| 6,418,575 | B1 | 7/2002 | Cheng | |
| 6,430,762 | B1 | 8/2002 | Cheng | |
| 6,434,767 | B1 | 8/2002 | Welsh, Jr. | |
| 6,526,608 | B1 | 3/2003 | Hsia | |
| 6,539,563 | B1 | 4/2003 | Hsia | |
| 6,550,082 | B2 | 4/2003 | Tharalson et al. | |
| 6,578,211 | B2 | 6/2003 | Tharalson et al. | |
| 6,687,927 | B1 | 2/2004 | Tharalson | |
| 6,704,949 | B2 | 3/2004 | Waldman et al. | |
| 6,763,539 | B1 | 7/2004 | Bartley et al. | |
| 6,862,757 | B2 | 3/2005 | Andriunas et al. | |
| 6,877,173 | B2 | 4/2005 | Tharalson et al. | |
| 6,877,176 | B2 | 4/2005 | Houghteling | |
| 6,931,677 | B2 | 8/2005 | Tharalson et al. | |
| 6,934,981 | B2 | 8/2005 | Waldman et al. | |
| 7,013,505 | B2 | 3/2006 | Martin | |
| RE39,136 | E * | 6/2006 | Tharalson et al. | 5/93.2 |
| 2003/0126681 | A1 * | 7/2003 | Tharalson et al. | 5/93.2 |
| 2003/0177574 | A1 | 9/2003 | Waldman et al. | |
| 2003/0196264 | A1 | 10/2003 | Tharalson et al. | |
| 2004/0181873 | A1 | 9/2004 | Waldman et al. | |
| 2005/0034232 | A1 | 2/2005 | Martin | |
| 2005/0262628 | A1 * | 12/2005 | Tharalson et al. | 5/93.1 |

OTHER PUBLICATIONS

Graco Changing Table Owner's Manual 2000.
Graco Infant Bassinet Owner's Manual 2000.

* cited by examiner

BEDSIDE BASSINETTES

RELATED APPLICATIONS

The instant application is a continuation in part of U.S. patent application Ser. No. 11/209,401, filed Aug. 22, 2005, which is a continuation of allowed U.S. application Ser. No. 10/448,538, filed May 28, 2003, now issued as U.S. Pat. No. 6,931,677, which claims priority to U.S. patent application Ser. No. 09/838,041, filed Apr. 20, 2001, now issued as U.S. Pat. No. 6,678,211, which reissued as U.S. patent application Ser. No. 09/838,041, now U.S. Reissue Pat. No. 39,136, which is a continuation-in-part of International application No. PCT/US00/14086, filed May 22, 2000, which was published under PCT Article 21(2) in English as International Publication No. WO 01/80692, which claims priority to U.S. patent application Ser. No. 09/552,331, now U.S. Pat. No. 6,148,456, which is a continuation-in-part of U.S. patent application Ser. No. 09/244,140, now U.S. Pat. No. 6,112,347, which is a continuation-in-part of U.S. patent application Ser. No. 08/903,640, now U.S. Pat. No. 5,845,349, which claims priority to U.S. Patent Application No. 60/039,728.

FIELD OF THE INVENTION

The instant invention relates to the field of convertible bassinettes for use with babies and very young children; in particular to units which may be easily converted from a conventional bassinette to a changing table or child's bedside sleeping enclosure, hereinafter referred to for convenience as a "bedside bassinette," that may be attached to a parental bed.

BACKGROUND

Bedside bassinettes are bassinets designed to allow the bassinette to be placed alongside a parental bed, to provide a safe location for an infant to sleep, while keeping the infant immediately adjacent to a parent.

Bedside bassinettes typically have a sleeping surface, positioned at or below the top surface of a parental bed against which the bedside bassinette has been placed. In order to prevent a sleeping infant from accidentally rolling off of the sleeping surface, the bedside bassinette typically has walls around the edges of the sleeping surface which are not abutted against a parental bed.

The inclusion of a wall along the edge of the sleeping surface which abuts the parental bed (hereafter referred to as the front edge in order to simplify the reference) may allow the bedside bassinette to be used as a conventional bassinette, when the wall is positioned to prevent an infant from rolling off the sleeping surface along that edge. Obviously, the inclusion of a fixed front wall can interfere with the ability of the bassinette to be used as a bedside bassinette. Such a fixed front wall could also limit the utility of the device as a changing table when the bedside bassinette is positioned away from a parental bed.

In order to allow a wall to be placed along this front edge, therefore, a cross-member is typically implemented, such that with the cross-member included, the wall along the front edge can be attached to the cross-member at an upper end to provide structural stability to the front wall. The upper cross-member, however, may need to be removed for the bassinette to be utilized as a bedside bassinette or changing table.

As shown in Applicant's earlier patents, the front wall may be formed from a flap which extends from the front edge of the sleeping surface, such that with the flap hanging below the sleeping surface, the bedside bassinette may be suitable for use as a changing table, while with the flap attached to the crossbar, the bedside bassinette may be suitable for use as a conventional bassinette.

In Applicant's U.S. Pat. No. 6,678,211, the use of a bedside bassinette having a front wall positioned at an intermediate height was disclosed. The use of the intermediate height provides additional safety for an infant laying on the sleeping surface. The front wall may be joined to the surrounding wall, such that it is ensured that a wall surrounds the sleeping surface to prevent an infant from rolling off of the sleeping surface. The use of an intermediate height front wall does not preclude either the use of a front flap style front wall, or the addition of a flap to the top edge of a joined intermediate height wall, such as to allow positioning of the front wall to create a conventional bassinette.

Accordingly, there are at least three potential positions at which it could be desired to have a front crossbar to provide support to a front wall, i.e., adjacent the sleeping surface, at the intermediate position, and at a full height position (such that the front wall has the same height as the other wall sections surrounding the sleeping surface.

Different methods of attaching the front crossbar have been used, such as the slide locks shown in Applicant's U.S. Pat. Nos. 6,148,456, 6,678,211, and 6,112,347. These methods each implement an attachment at both ends in order to allow the height of the front crossbar to be adjusted. These methods, however, may be cumbersome if one-handed adjustment of the crossbar is attempted, such as when a care-giver is holding an infant while attempting to adjust the height of the front crossbar.

SUMMARY OF THE INVENTION

The present invention is a bassinette which can be alternately configured as a conventional bassinette, or as a bassinette having a lowered front wall. The bassinette may include an enclosure, with the enclosure surrounding a sleeping platform, and the enclosure further including left and right side walls, a rear wall, and a front wall. The left and right side walls may have a side wall height, and the front wall may have a fixed portion which has a height less than the height of the left and right side walls. The front wall further may have a flap portion extending from the front portion. The flap portion may have a front upper cross-member, where the front upper cross-member has an end fitting adjacent a first end of the front upper cross-member, and a retractable tongue adjacent a second end of the front upper cross-member, where the retractable tongue includes an actuator that allows a user to selectively retract the retractable tongue. The bassinette further may have a frame for supporting the enclosure. The frame may have a left front member and a right front member, and a first receiver cup on the left front member and a second receiver cup on the right front member and a distance between the first receiver cup and the second receiver cup. The upper front cross-member may have a length greater than the distance between the first receiver cup and the second receiver cup. The length of the upper front cross-member may be selected such that when the end fitting is inserted in the first receiver cup and the tongue is retracted, the upper cross-member may be positioned between the first receiver cup and the second receiver cup, such that when the tongue is extended, the upper cross-member is engaged between the first and second receiver cups. When the upper cross-member is engaged between the first and second receiver cups, the front wall flap may then be positioned to extend the front wall to a height substantially equal to the height of the left and right side walls, and when the upper cross-member is disengaged from the first and second receiver cups, the flap portion of the front wall may then be able to hang from an edge of the fixed portion of the front wall.

Alternatively, the bassinette may include an enclosure, the enclosure having a platform on which an infant can be placed. The enclosure may further have right, left, front, and rear walls, where the right, left and rear walls have a first height, and the front wall has a lower portion and an upper portion, where the lower portion has a first side edge, a second side edge, a lower portion top edge and a lower portion bottom edge, with the lower portion bottom edge being joined to the platform, the top edge being joined to the upper portion, the lower portion being joined to the right side and left side walls along the first side edge and second side edge and forming a front wall having a height less than the height of the right, left and rear walls, where the upper portion has an upper portion lower edge and a upper portion upper edge. Also a frame may be included to support the enclosure and further have a left front section and a right front section, where the left front section and the right front section each have a receiver cup mounted thereon. The frame further may have a retention member for retaining the bassinette against a parental bed. Further included may be an intermediate cross-member having a first end and a second end, and extending along the lower portion top edge. There also may be a front upper cross-member having a first end and a second end, and extending along the upper portion top edge of the front wall, the front upper cross-member further having an end fitting adapted to be received in a receiver cup disposed at a first end of the front-upper cross-member and a retractable tongue adapted to be received in a receiver cup disposed at a second end of the front upper cross-member, with the retractable tongue being selectively retractable by a user of the front upper cross-member. The intermediate cross-member may be joined at its first end to the right front section and the second end may be joined to the left front section. When the end fitting is disposed in the first receiver cup and the retractable tongue is extended and disposed within the second receiver cup, the front upper cross-member may be trapped between the first and second receiver cups, and the upper portion of the front wall held in a position such that the upper portion top edge is at a height substantially the same as the height of the right and left side walls.

DETAILED DESCRIPTION OF THE INVENTION

In order to provide a more full understanding of the present invention, a discussion of embodiments of the present invention is provided as follows, in which like reference numbers within the Figures indicate like elements.

Figure 1:
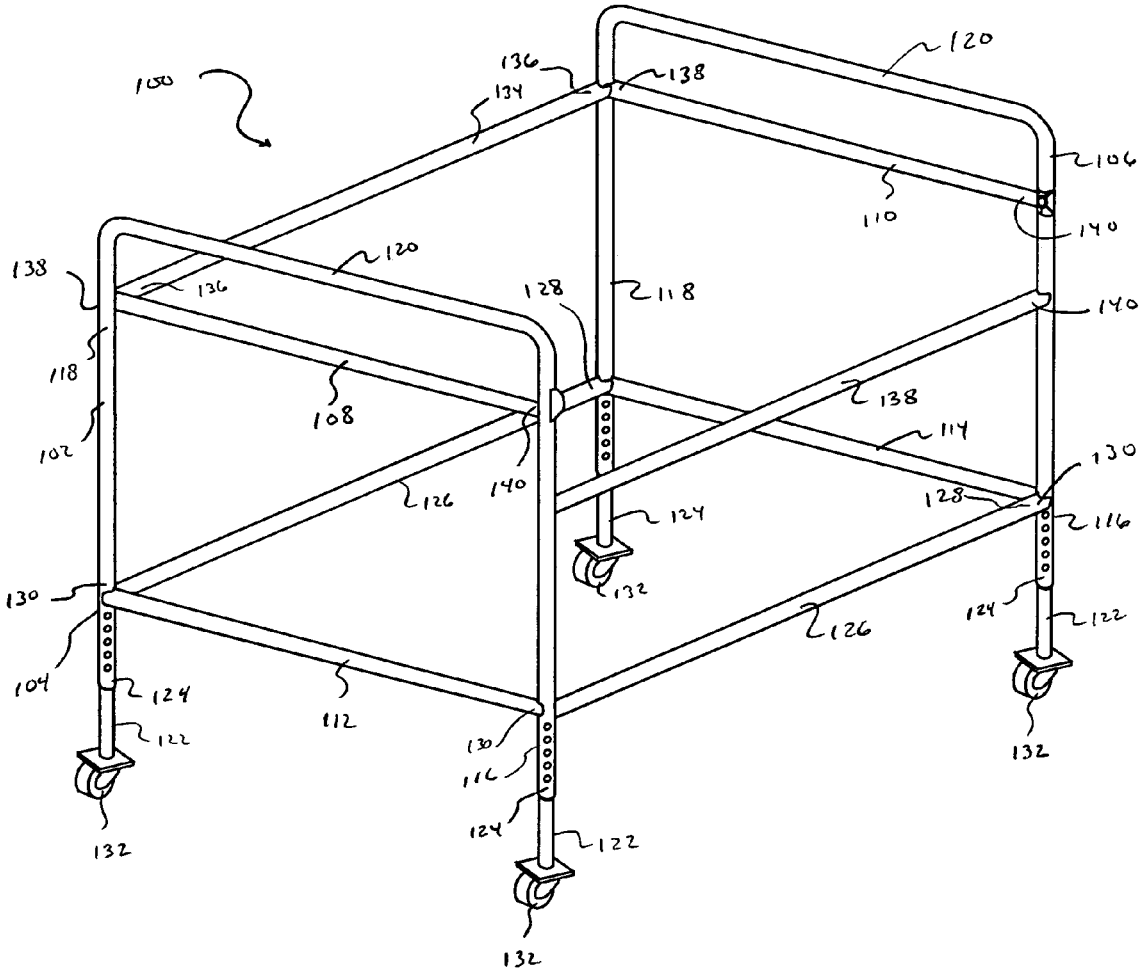
FIG. 1 illustrates the structural frame of a notional bedside bassinette embodying the present invention.

In FIG. 1 there is shown the structural elements of a bedside bassinette 100 according to the present invention. The bedside bassinette 100 may typically have a sleeping surface, not shown in this view, disposed within a frame 102. The frame may utilize a pair of u-shaped end sections 104, 106. The unshaped end sections 104, 106 may each be provided with an upper side cross-member 108, 110 and a lower side cross-member 112, 114. The upper and lower side cross-members 108, 110, 112, 114 may extend from a first leg 116 of a u-shaped end section to the second leg 118 of the u-shaped end section.

The u-shaped end sections 104, 106 may be disposed with the closed end 120 of the "u" pointing upward. Telescoping segments 122 may be provided internal or external to the free ends 124 of the u-shaped end sections 104, 106 to allow adjustment of the height of the sleeping surface relative to the height of a top surface of a parental bed.

The u-shaped end sections 104, 106 may be connected by lower lateral cross-members 126. The lower lateral cross-members 126 may be positioned such that the ends 128 of the lower lateral cross-members 126 intersect the legs 116, 118 of the u-shaped end sections 104, 106 adjacent the positions 130 at which lower side cross-members 112, 114 intersect the u-shaped end section legs 116, 118, thus forming a generally planar series of cross-members.

Casters 132 may be disposed on the ends of the telescoping segments 122, such that the bedside bassinette 100 may be readily rolled from one location to another. The casters 132 may be provided with locks, such that once the bedside bassinette 100 has been rolled into position, the casters 132 may be locked to prevent undesired rolling of the bedside bassinette 100, such as could occur if the bedside bassinette 100 were pushed by a child.

The u-shaped end sections 104, 106 may further be connected by a rear upper cross-member 134, positioned such that the ends 136 of the upper rear cross-member intersect the legs 116, 118 of the u-shaped end sections 104, 106 adjacent the positions 138 at which the rear upper cross-member ends 136 intersect the u-shaped end section 104, 106 legs 116, 118.

Finally, the u-shaped end sections 104, 106 may also be connected by a front intermediate cross-member 138, positioned such that the ends 140 of the front intermediate cross-member 138 intersect the legs 116, 118 of the u-shaped end section 104, 106 at positions below the positions at which the upper side cross-member ends 140 intersect the unshaped end section legs 116, 118.

Figure 2:
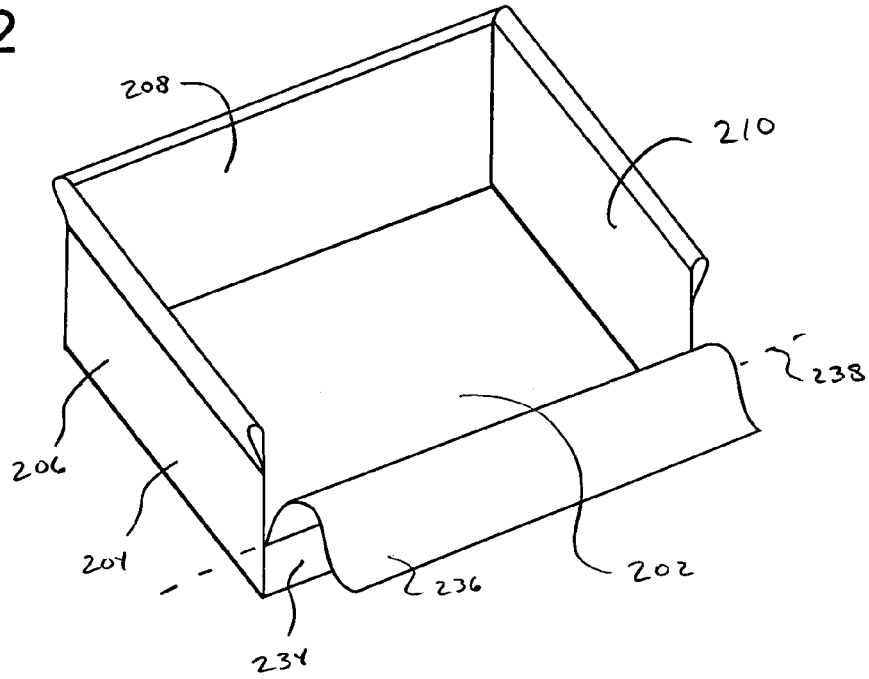
FIG. 2 illustrates an enclosure of a notional bedside bassinette consistent with the present invention.
Figure 2A:
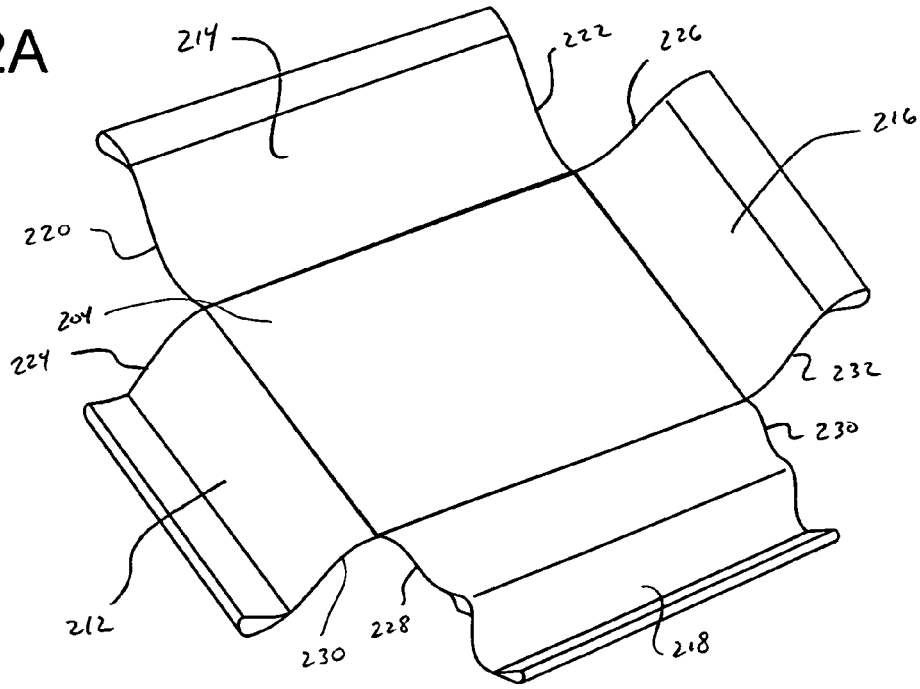
FIG. 2A illustrates a notional enclosure consistent with the present invention, shown in a flat plan condition.

As shown in FIG. 2, the sleeping surface 201 (not shown) may be formed as part of an enclosure 204 which may be attached to the frame. In the illustrated embodiment, the enclosure 204 may be formed by wall sections 206, 208, 210 bounding a substantially rectangular sleeping surface 202. The wall sections 206, 208, 210 may be formed as flaps (as shown in FIG. 2A as elements 212, 214, 216) and surrounding the rectangular sleeping surface 204, with the left 220 and right 222 side edge of the back section 214, 218 joined to the rear edges 224, 226 of the right 216 and left 212 sections, such that three walls 206, 208, 210 are thus formed. The front panel 218 may be joined along a portion of the left 228 and right 230 side edges of the front section joined to a portion of the front edges 230, 232 of the left 212 and right 216 side wall sections, such that a wall 234 having a lower height (shown in FIG. 2) than the side 206, 210 or rear walls 208 is formed, with a flap 236 extending above the level 238 at which the front panel 218 has been joined to the side walls 206, 210. Alternatively, the front panel may be integral with the side walls, such that no joining method need be imposed, or alternatively provide with a selective joining method such as a zipper, snaps, buttons, or hook and loop fasteners.

The sleeping surface 202 may be formed by using a fabric floor section extending between the front 234 and rear 208 walls, and the left 206 and right 210 side walls. A mattress or stiffener may be inserted into the pocket formed by the walls as desired.

Figure 3:
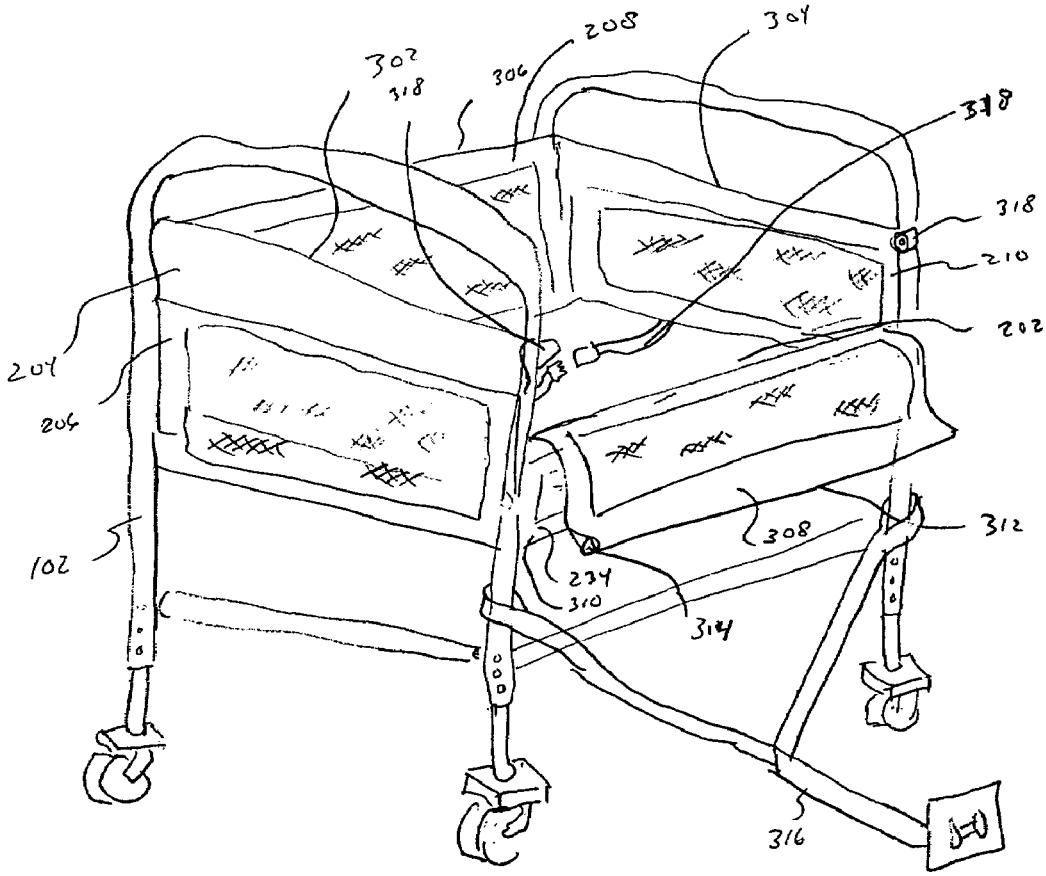
FIG. 3 illustrates a notional enclosure assembled to a notional frame embodying the present invention

As shown in FIG. 3, the enclosure 204 may be attached to the frame 102 by securing the top edges 302, 304 of the right and left side walls 206, 210 to the left and right upper side cross-members (not visible in view), by securing the top edge 306 of the rear wall 208 to the rear upper cross-member (not visible in illustration), and by securing the front wall 234 to the front intermediate cross-member (not visible in illustration). The connection between the front wall and the front intermediate cross-member may allow for a remaining portion of the front wall to form a flap 308 extending from the lower portion 310 of the front wall 234 which is secured to the front intermediate cross-member. The top edge 312 of the flap may be secured to a front upper cross-member 314.

The bedside bassinette 100 may also be provided with a retention strap 316 for retaining the bedside bassinette 100 against a parental bed (not shown), as well as a changing strap 318 to prevent an infant from rolling when placed on the sleeping surface 202 for changing.

Also shown in FIG. 3 are a pair of front upper cross-member receiver cups 318 positioned at a height substantially equal to the height of the left and right upper cross-members (not visible). These receiver cups 318 allow the front upper cross-member 314 to be selectively joined to the frame 102 to allow the bedside bassinette to function as a conventional bassinette 100, with a full height surrounding wall to prevent an infant from accidentally falling from the sleeping surface 202.

Figure 4:
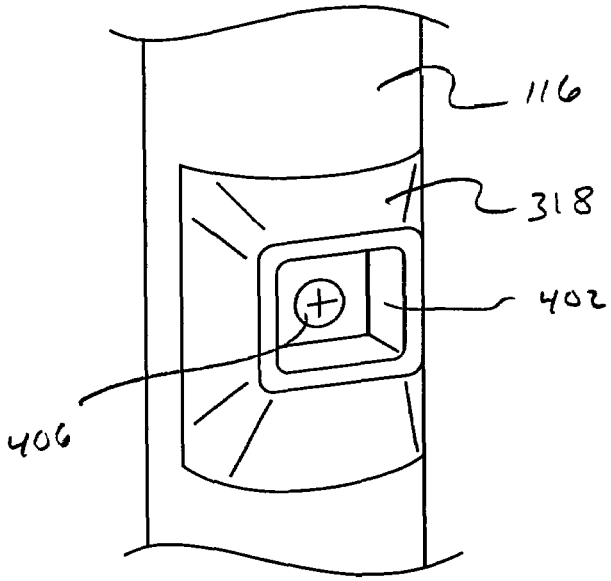
FIG. 4 illustrates a receiver cup according to the present invention.
Figure 5:
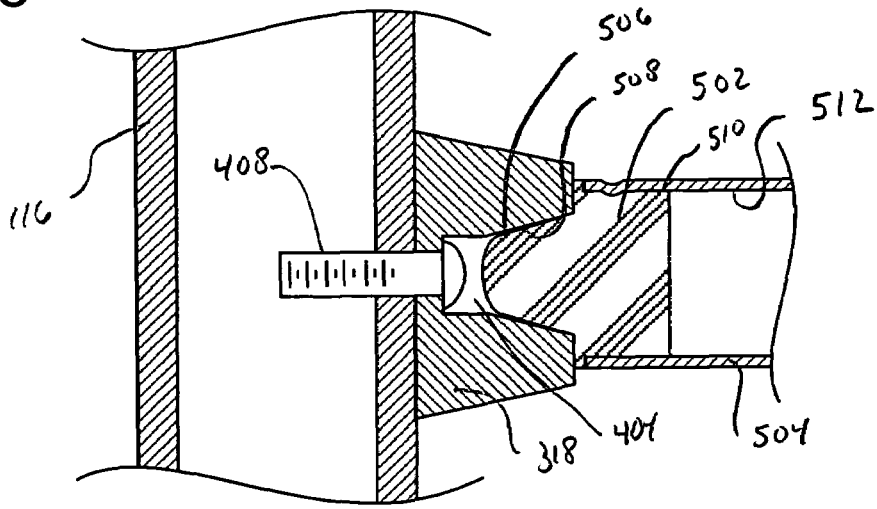
FIG. 5 illustrates a receiver cup into which an end fitting has been inserted.

FIG. 4 illustrates a receiver cup 318 attached to a leg (i.e., 116 or 118) of a u-shaped end-section. The receiver cup 318 may comprise a cup portion 402 forming an interior cavity 402 joined 406 to the leg 116 such that the position of the receiver cup 318 is fixed. As shown in FIG. 5, the receiver cup 318 may be affixed to the leg via a simple self threading screw 408 which secures the receiver cup 318 to the leg 116. The use of a wall 410 completely surrounding an interior cavity 404 limits the ability of a cross-member end fitting 502 to move relative to the receiver cup 318 unless the cross-member end fitting 502 is withdrawn from the cup by motion along an axis parallel to the center axis of the cross-member 504.

Figure 6:
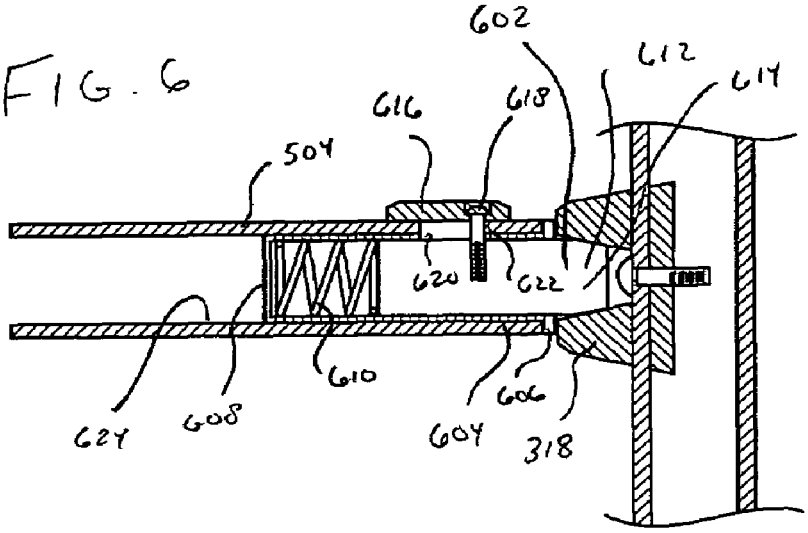
FIG. 6 illustrates an embodiment of a retractable tongue in accordance with the present invention.
Figure 6A:
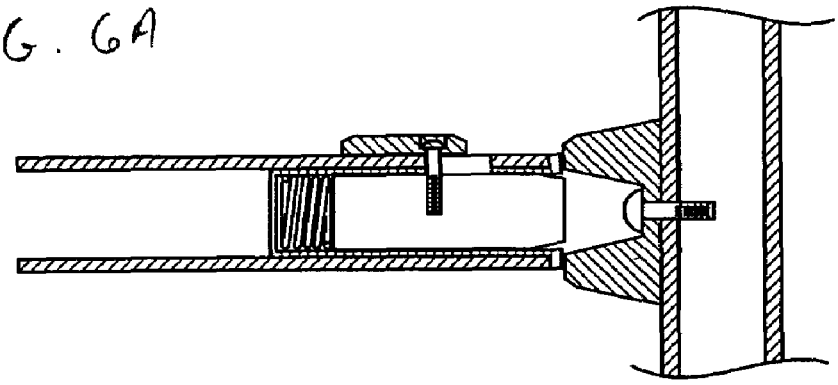
FIG. 6A illustrates an alternate embodiment of a retractable tongue in accordance with the present invention.

FIG. 6 illustrates the opposite end of a generic cross-member 504, showing one embodiment of a retractable tongue 602 which may be utilized to allow the length of the cross-member 504 to be retracted (shown in FIG. 6A) by an amount sufficient to allow the cross-member 504 to be inserted into a receiving cup 318. The end of the cross-member 604 may be provided with a sleeve 606 which is inserted into an open end of the cross-member 504. The sleeve 606 may have a block 608 at its inner end, to prevent a spring 610 or other elastic member from traversing past the end of the sleeve 606. The tongue 612 itself may be formed by a slidable block 614 which fits within the sleeve 606. An actuator 616 may be attached to the slidable block 614, such as by a self-threading screw 618. The screw 618 may pass through the outer wall of the cross-member 504 through a slot 620 in the outer wall. The slot 620 may be configured such that at a distal end 622 of the slot, the screw 618 bears against the end 622 of the slot 620, preventing the slidable block 614 from sliding out of the sleeve 606. The sleeve 606 may be retained within the cross-member 504 by an interference fit between the sleeve 606 and the interior surface 624 of the cross-member 504, by the inclusion of a mechanical fastener (not shown) securing the sleeve to the cross-member, such as a threaded fastener or rivet, though the use of a bonding or adhesive agent (not shown) between the sleeve and the inner surface of the cross-member, or through the creation of a mechanical interference between the outer wall of the cross-member and the sleeve, such as by forming an indented dimple (not shown) in the outer wall of the cross-member.

Figure 7:
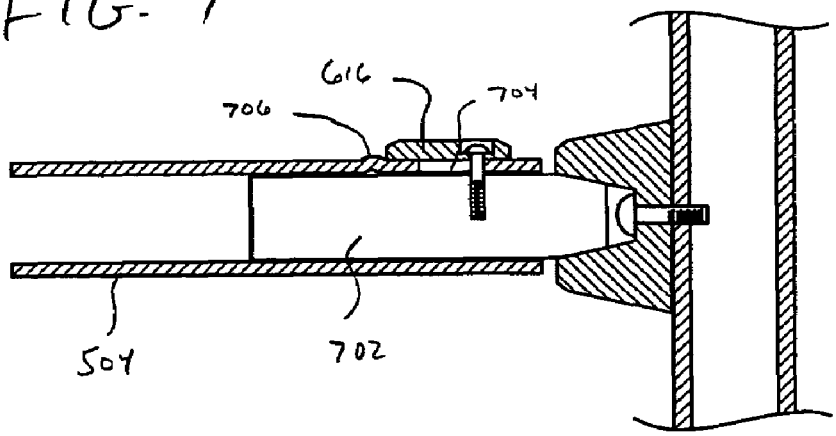
FIG. 7 illustrates an embodiment of a retractable tongue in accordance with the present invention.

As shown in FIG. 7, the retractable tongue 602 does not need to be elastically loaded into an extended position (although it is preferable from a safety standpoint), nor is it required that a sleeve be utilized within the end of the cross-member. As shown, a slidable block 702 may be inserted directly into the cross-member 504, with an actuator 616 fastened through a slot 704 to the slidable block 702. A detent 706 may be provided for the actuator 616, such that the actuator 616 is disposed to hold the slidable block in an extended position, rather than allow the slidable block to slide freely between extended and retracted positions. A second detent may be provided to bias the actuator to remain in a retracted position.

Figure 8:
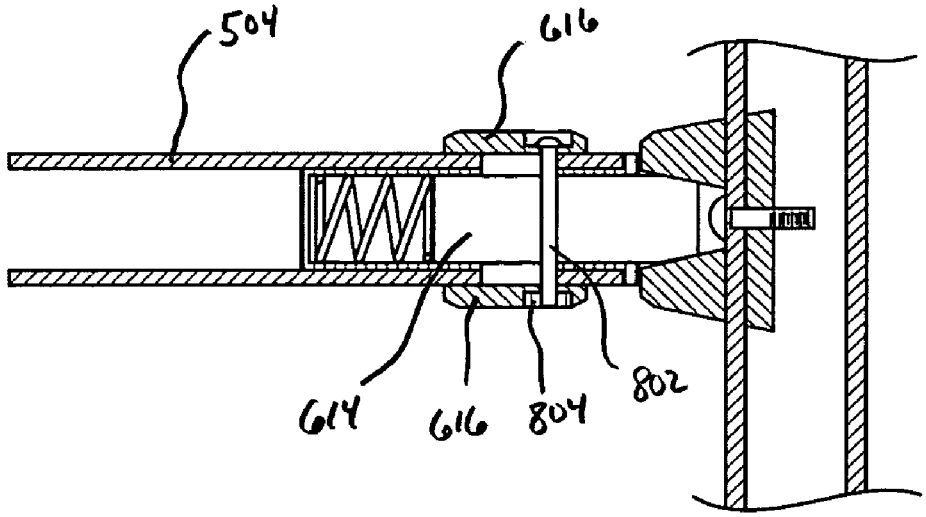
FIG. 8 illustrates an embodiment of a retractable tongue in accordance with the present invention.

As shown in FIG. 8, two actuators 616 may be disposed on opposite sides of the slidable block 614 such that an operator can retract the slidable block 614 from either side of the cross-member 504, or by applying force to both sides concurrently. The actuators 616 may be attached to the slidable block 614 by a bolt 802 which extends through the actuators 616 and the slidable block 614, and which may be retained by a nut 804.

Returning to FIG. 5, an end fitting 502 is shown on a cross-member 504 for insertion into a receiver cup 318. In order for the cross-member 504 to be installable into the receiver cup 318, the cross-member 504 must be free to rotate to a limited extent due to physical interference created by the opposite receiver cup (not shown) and the length of the cross-member. The freedom to rotate may be created simply by loose tolerances between the end fitting 502 and the receiver cup 318, or may be created through the shapes chosen for the interior cavity 404 of the receiver cup 318 and the profile of the end fitting 502. If the end fitting 502 were configured with a cylindrical shape, and the interior cavity of the receiver cup 318 likewise formed with a cylindrical shape, the cross-member 504 would be significantly restrained, such that rotation of the cross-member 504 to allow the retractable tongue 602 end of the cross-member 504 to clear the receiver cup 318 adjacent to the retractable tongue 602 end could require bending of the cross-member 504 itself. The use of cylindrical shapes would also increase the difficulty of inserting the end fitting 502 into the receiver cup 318, which could be a disadvantage where a user was attempting to set the cross-member single-handedly.

As shown, the receiver cup 318 may be provided with a cylindrical or conical shape 506 to allow a conically shaped 508 end fitting to be more easily started into the interior cavity 404. The end fitting 502 may be provided with a rounded end to further ease the ability to mate the end fitting 502 with the receiver cup 318. The end fitting 502 may be formed as a plug which can be inserted into an open end of the cross-member 504, and retained within the cross-member 504 by an interference fit between the outer surface 510 of the plug and the inner surface 512 of the cross-member. Alternately, such a plug could be bonded or adhered to the cross-member 504, or retained with a mechanical fastener, such as a screw or other threaded fastener, or retained to the cross-member via a mechanical interference, such as the forming of a dimple into the outer surface of the cross-member after the plug has been inserted within the cross-member.

Figure 9:
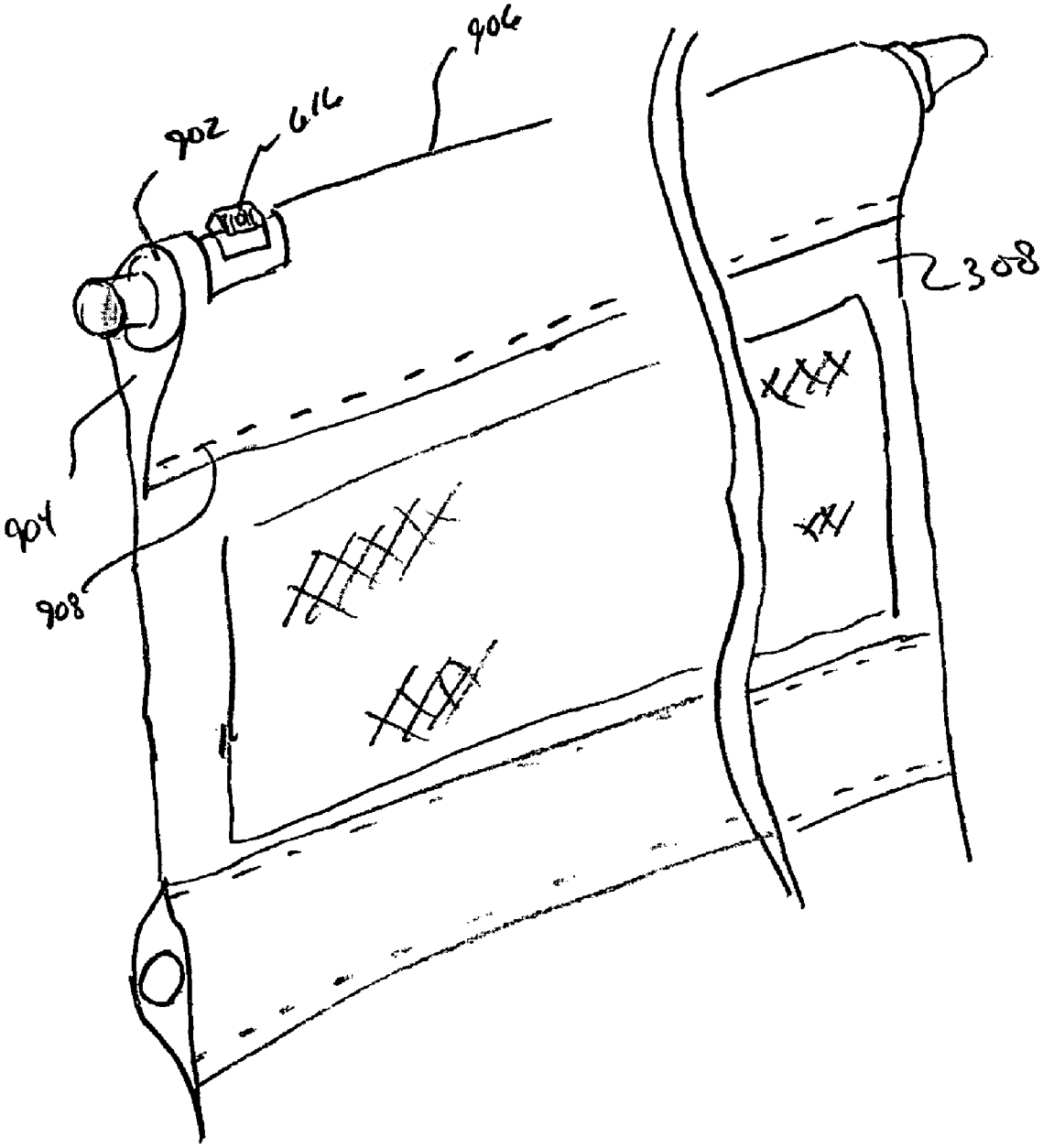
FIG. 9 illustrates a front wall in accordance with an aspect of the present invention.

From the above, it is evident that a user of the bedside bassinette 100 as shown in FIG. 3, could convert the device into a conventional bassinette by trapping the front upper cross-member 314 between the receiver cups 318 to hold the front wall 308 in a full height position. As shown in FIG. 9, the front upper cross-member 902 may be fixed to the end of the flap portion 308, such as by inserting the cross-member 902 through a pocket 904 formed adjacent the top edge 906 of the flap portion 308. The user could then grasp the end of the cross-member 902 adjacent the actuator, and position the end fitting end of the cross-member within one receiver cup. Next, by retracting the retractable tongue through use of the actuator 616, the upper cross-member 902 could be aligned with the second receiver cup (not shown), such that allowing the retractable tongue to extend would cause the cross-member to be trapped between the receiver cups, and thus retained in position.

As shown in FIG. 9, allowing the actuator 616 to be accessible to a user may require accommodation of the actuator 616 in the design of the front wall portion 308 attached to the cross-member 902 adjacent to the actuator 616. The front wall portion 308 illustrated in FIG. 9 embodies a pocket 904 created by folding over a portion of the front wall 308, and stitching 908 or otherwise joining the folded over portion to the flap portion.

While the description provided above has addressed implementing a removable upper front bar, both the upper front bar and intermediate bars may be formed to allow for their removal, such that one bedside bassinet could be configured as a changing table with no front wall, as a bedside bassinette or changing table with a partial height front wall, or as a conventional bassinette, with a full height front wall.

Figure 10:
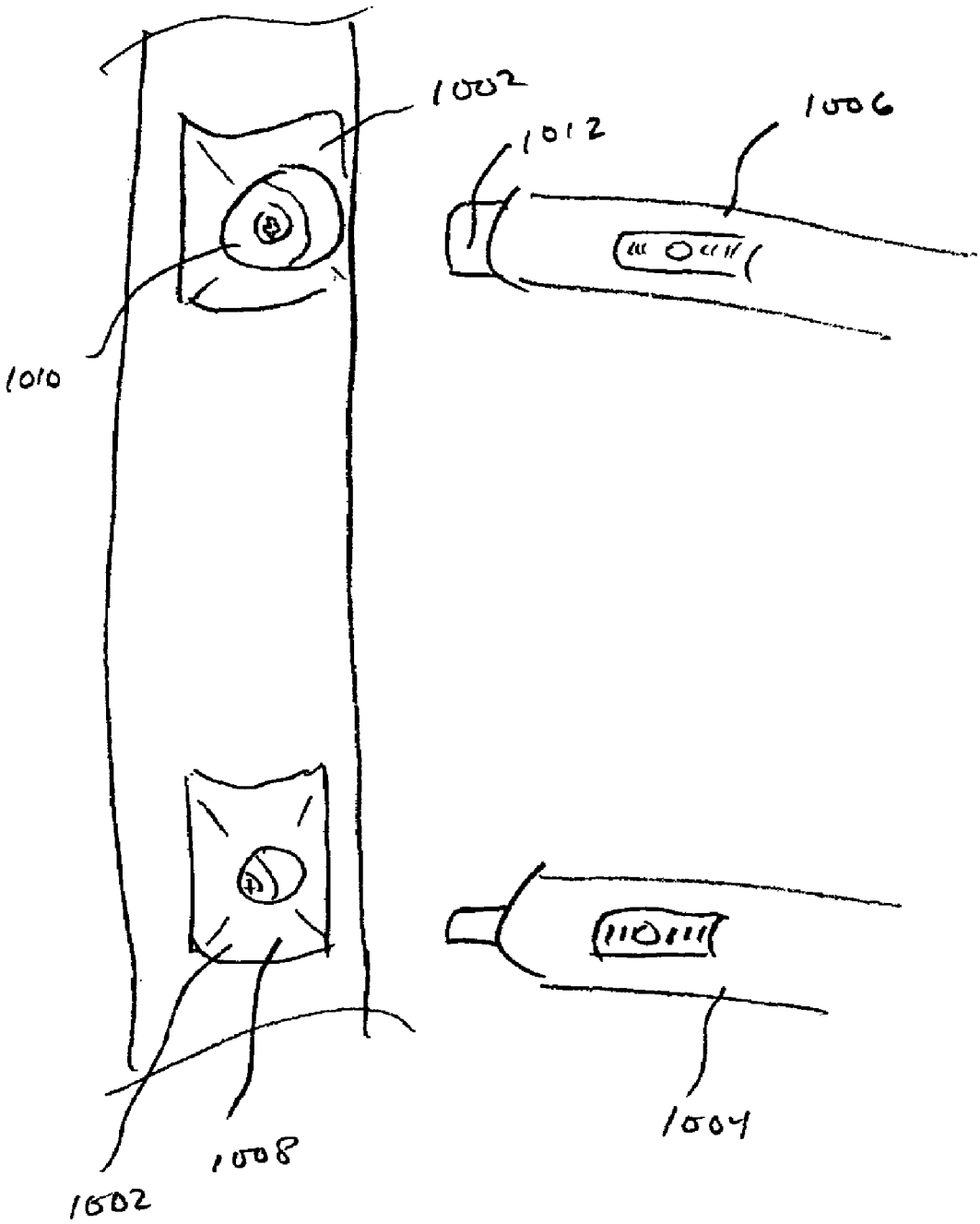
FIG. 10 illustrates an alternate implementation of the present invention in which retractable tongues are included for both intermediate and upper cross-members in accordance with the present invention.

In order to accomplish this full range, as shown in FIG. 10, receiver cups 1002 may be provided for an intermediate cross-member 1004, as well as for a front upper cross-member 1006. The receiver cups for the different levels may selected such that the front upper cross-member 1006 cannot be inserted between the intermediate level receiver cups 1008, such as by using a larger diameter end fitting 1010 and tongue 1012 on the front upper cross-member 1006 than can be accepted by the intermediate level receiver cups 1008. Preventing the front upper cross-member 1006 from being installed at the intermediate level may prevent gaps from forming between the side edges of the front wall and the front edges of the side walls (not shown), preventing an infant from being able to fall through the gaps which would other wise be formed.

The previous description of the preferred embodiments is provided to enable any person skilled in the art to make and use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. A bassinette which can be alternately configured as a conventional bassinette, or as a bassinette having a lowered front wall, the bassinette comprising:

an enclosure, said enclosure surrounding a sleeping platform, said enclosure further comprising left and right side walls, a rear wall, and a front wall, said left and right side walls having a side wall height, said front wall having a fixed portion having an intermediate height less than the height of the left and right side walls, said front wall further comprising a flap portion extending from said fixed portion, said flap portion comprising a front upper cross-member, said front upper cross-member having an end fitting adjacent a first end of said front upper cross-member, and a retractable tongue adjacent a second end of said front upper cross-member, said retractable tongue comprising an actuator allowing a user to selectively retract said retractable tongue;

a frame, said frame for supporting said enclosure, said frame comprising a left front member and a right front member, said frame further comprising a first receiver cup on said left front member and a second receiver cup on said right front member and a distance between said first receiver cup and said second receiver cup;

wherein said upper front cross-member has a length greater than the distance between said first receiver cup and said second receiver cup, said length selected such that when said end fitting is inserted in said first receiver cup and said tongue is retracted, said upper cross-member may be positioned between said first receiver cup and said second receiver cup, such that when said tongue is extended, said upper cross-member is engaged between said first and said second receiver cups; and wherein when said upper cross-member is engaged between said first and said second receiver cups, said front wall flap is positioned to extend the front wall to a height substantially equal to the height of the left and right side walls, and wherein when said upper cross-member is disengaged from said first and second receiver cups, said flap portion of said front wall is able to hang from an edge of said fixed portion of said front wall, wherein said front upper cross-member further comprises a slot located adjacent the second end of said front upper cross-member, and where said retractable tongue further comprises a sliding block disposed within said upper front cross-member, said sliding block being connected to said actuator by a mechanical fastener, said mechanical fastener extending from said actuator through said slot and being fastened to said sliding block.

2. A bassinette according to claim 1, wherein said retractable tongue further comprises a spring element which biases the sliding block into an extended position.

3. A bassinette according to claim 1, wherein said retractable tongue further comprises a detent such that said retractable tongue is retained in an extend position unless said detent is overcome.

4. A bassinette according to claim 2, wherein said retractable tongue comprises a cross-member insert, said cross-member insert having an open end and a closed end, said open end having a lip adapted to bear against an end of said upper front cross-member, said insert being adapted such that said sliding block is able to slide within said insert, and wherein said spring element is positioned such that the spring element bears against the closed end of said insert.

5. A bassinette according to claim 2, wherein said retractable tongue further comprises a spring plug, said spring plug being disposed within said cross-member, and wherein said spring element bears against said plug.

6. A bassinette according to claim 5, wherein said plug is retained at a position within said upper front cross-member by a mechanical fastener.

7. A bassinette according to claim 5, wherein said plug is retained at a position within said upper front cross-member by a feature formed on the inner surface of the upper front cross-member.

8. A bassinette which can be alternately configured as a conventional bassinette, or as a bassinette having a lowered front wall, the bassinette comprising:

an enclosure, said enclosure comprising a platform on which an infant can be placed, said enclosure further comprising right, left, front, and rear walls, said right, left and rear walls having a first height, said front wall having a lower portion and an upper portion, said lower portion having a first side edge, a second side edge, a lower portion top edge and a lower portion bottom edge, said lower portion bottom edge being joined to said platform, said top edge being joined to said upper portion, said lower portion being joined to said right side and left side walls along said first side edge and said second side edge and forming a front wall having a height less than the height of right, left and rear walls, said upper portion having an upper portion lower edge and a upper portion upper edge;

a frame, said frame supporting said enclosure and further comprising a left front section and a right front section, said left front section and said right front section each having a receiver cup mounted thereon, said frame further comprising a retention member for retaining said bassinette against a parental bed;

an intermediate cross-member, said intermediate cross-member having a first end and a second end, and extending along said lower portion top edge; and a front upper cross-member, said front upper cross-member having a first end and a second end, and extending along said upper portion top edge of said front wall, said front upper cross-member further having an end fitting adapted to be received in a receiver cup disposed at a first end of said front-upper cross-member and a retractable tongue adapted to be received in a receiver cup disposed at a second end of said front upper cross-member, said retractable tongue being selectively retractable by a user of said front upper cross-member;

wherein the intermediate cross-member is joined at its first end to said right front section and said second end is joined to said left front section;

wherein when said end fitting is disposed in said first receiver cup and said retractable tongue is extended and disposed within said second receiver cup, said front upper cross-member is trapped between said first and second receiver cups, and said upper portion of said front wall is held in a position such that the upper portion top edge is at a height substantially the same as the height of the right and left side walls;

wherein said retractable tongue comprises a sliding block and a first actuator, said sliding block being adapted to slide within said upper front cross-member, said first actuator being disposed such that a user of said upper front cross-member may selectively retract said sliding block within said cross-upper front member to allow said upper front cross-member to be disposed and trapped between said first and second receiver cups.

9. A bassinette according to claim 8, wherein said retractable tongue further comprises a spring element which biases the sliding block into an extended position.

10. A bassinette according to claim 9, wherein said first actuator is connected to said sliding block via a mechanical fastener which extends through a first slot formed in the outer surface of the front upper cross-member.

11. A bassinette according to claim 10, wherein said slot is formed such that when said mechanical fastener is located at a distal end of said slot, said mechanical fastener prevents said sliding block from being withdrawn from said front upper cross-member.

12. A bassinette according to claim 10, further comprising a second actuator, said second actuator being disposed opposite said first actuator, said second actuator being connected to said sliding block via a mechanical fastener which extends through a second slot formed in the outer surface of the front upper cross-member.

13. A bassinette according to claim 12, wherein said slot is formed such that when said mechanical fastener is located at a distal end of said slot, said mechanical fastener prevents said sliding block from being withdrawn from said front upper cross-member.

14. A bassinette according to claim 8, wherein said intermediate cross-member comprises an intermediate cross-member end fitting at the a first intermediate cross-member end and an intermediate cross-member retractable tongue at said second intermediate cross-member end, and wherein said left front section and right front section of said frame further comprise intermediate receiver cups located on said left front section and said right front section below said first receiver cup and said second receiver cup, and wherein said front wall lower portion is selectively joined to said right side and left side walls along said first side edge and said second side edge.

15. A bassinette according to claim 14, wherein said intermediate receiver cups are adapted to prevent insertion of the front upper cross-member end fitting or front upper cross-member retractable tongue into said intermediate receiver cups.

16. A bassinette according to claim 14, wherein said intermediate cross-member retractable tongue comprises a sliding block and a first actuator, said sliding block being adapted to slide within said upper front cross-member, said first actuator being disposed such that a user of said intermediate cross-member may selectively retract said sliding block within said intermediate cross-member to allow said intermediate cross-member to be disposed and trapped between said first and second intermediate receiver cups.

17. A bassinette according to claim 16, wherein said intermediate cross-member retractable tongue further comprises a spring element which biases the sliding block into an extended position.

* * * * *